US007464828B1

(12) United States Patent
Unrau et al.

(10) Patent No.: US 7,464,828 B1
(45) Date of Patent: Dec. 16, 2008

(54) CONTAINER FOR STORING TOILETRY ITEMS

(76) Inventors: Donald T. Unrau, 3126 SE. 10th Ave., Portland, OR (US) 97202; Audrey C. Unrau, 3126 SE. 10th Ave., Portland, OR (US) 97202

( * ) Notice: Subject to any disclaimer, the term of this patent is extended or adjusted under 35 U.S.C. 154(b) by 600 days.

(21) Appl. No.: 11/137,926

(22) Filed: May 25, 2005

(51) Int. Cl.
*B65D 6/06* (2006.01)

(52) U.S. Cl. ..... 220/8; 206/1.5

(58) Field of Classification Search ..... None
See application file for complete search history.

(56) References Cited

U.S. PATENT DOCUMENTS 1,163,773 A * 12/1915 Ross ..... 206/1.5
1,895,061 A * 1/1933 Worssam ..... 132/287
1,944,502 A * 1/1934 Factor ..... 190/33
2,633,615 A * 4/1953 Donovan ..... 211/51
4,909,406 A * 3/1990 Wu ..... 220/8
4,932,547 A * 6/1990 Rodriguez ..... 220/8
7,128,220 B2 * 10/2006 Baitz ..... 211/51
2004/0027558 A1 * 2/2004 Baitz ..... 356/71

* cited by examiner

*Primary Examiner*—Stephen Castellano
(74) *Attorney, Agent, or Firm*—John Smith-Hill; Smith-Hill and Bedell

(57) ABSTRACT

A container for storing toiletry items includes an outer sleeve having first and second opposing side walls and opposing front and rear walls. The side walls and the front and rear walls of the outer slide define an interior space and an opening providing access to the interior space. The container also includes an inner slide that is a snug sliding fit within the outer sleeve and has a base, first and second opposing side walls and first and second opposing end walls. The base, the side walls and the end walls define an interior space of the inner slide. An interior wall of the inner slide divides the interior space of the inner slide into first and second compartments. A panel that is hingedly attached to the interior wall and is movable between an open position, in which the interior space of the first compartment is exposed, and a closed position, in which the interior space of the first compartment is concealed.

6 Claims, 1 Drawing Sheet

CONTAINER FOR STORING TOILETRY ITEMS

BACKGROUND OF THE INVENTION

This invention relates to a container for storing toiletry items.

The typical bathroom in a private home contains a conventional toilet bowl fixture. Various consumer products are used in conjunction with the toilet bowl fixture, including toilet paper and feminine hygiene products (tampons and sanitary napkins). Women often prefer to place their feminine hygiene products in a discreet location.

Feminine hygiene products are conventionally packaged in boxes made of thin cardboard or in bags made of thin plastic film. The packages are labeled in bold colors and graphics. The bold packaging might be considered desirable in advertising and for display in stores but is not conducive to discreet storage near the toilet bowl fixture. The bags made of thin plastic film are particularly inconvenient because the contents readily fall from the bag and are scattered over the floor of the bathroom. Consequently, many women opt to store their feminine hygiene products away from the toilet bowl, for example in a bathroom cabinet, even though this might be inconvenient.

SUMMARY OF THE INVENTION

In accordance with a first aspect of the present invention there is provided a container for storing toiletry items, the container comprising an outer sleeve comprising first and second opposing side walls and opposing front and rear walls, the side walls and the front and rear walls defining an interior space and an opening providing access to the interior space, and an inner slide comprising a base, first and second opposing side walls and first and second opposing end walls, the base, the side walls and the end walls defining an interior space, and the inner slide also comprising an interior wall that divides the interior space of the inner slide into first and second compartments, and a panel that is hingedly attached to the interior wall and is movable between an open position, in which the interior space of the first compartment is exposed, and a closed position, in which the interior space of the first compartment is concealed, wherein the inner slide is a snug sliding fit within the outer sleeve.

In accordance with a second aspect of the present invention there is provided a container for storing toiletry items, the container comprising an outer sleeve comprising first and second opposing side walls and opposing front and rear walls, the side walls and the front and rear walls defining an interior space and an opening providing access to the interior space, and an inner slide comprising a base, first and second opposing side wall and first and second opposing transverse walls, the base, the side walls and the transverse walls defining an interior space, and the inner slide also comprising a panel that is hingedly attached to a transverse wall of the inner slide and is movable between an open position, in which at least a portion of the interior space of the inner slide is exposed, and a closed position, in which said portion of the interior space of the inner slide is concealed, wherein the inner slide is a snug sliding fit within the outer sleeve.

BRIEF DESCRIPTION OF THE DRAWINGS

For a better understanding of the invention, and to show how the same may be carried into effect, reference will now be made, by way of example, to the accompanying drawings, in which.

Figure 3:
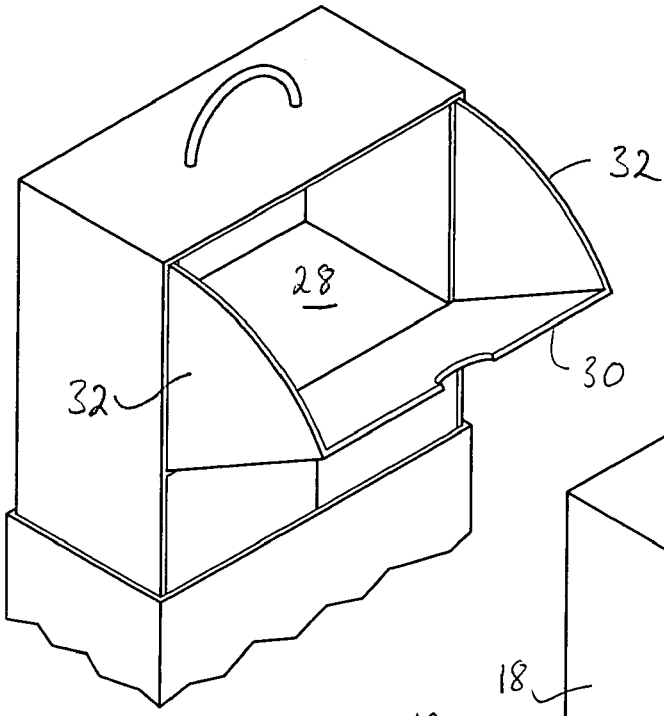
FIG. 3 is a partial perspective view of the bathroom caddy in a fully open position.

The bathroom caddy is shown in the drawings in the orientation in which it would normally be used, and words of orientation are used accordingly in the following detailed description. However, this is not intended to imply that the caddy might not be used in another orientation, or that it is intended that the claims should be restricted to a caddy designed to be used in the orientation shown in FIG. 1.

DETAILED DESCRIPTION

The bathroom caddy shown in the drawings comprises an outer sleeve 10 and an inner slide 12, both of which are made of cardboard. As shown, the outer sleeve has two pairs of opposite walls that define a rectangular section chamber which is open at the upper end of the sleeve and is partially closed at the lower end of the sleeve by a lower wall 14. The inner slide 12 is configured as a drawer, having a base 16, two side walls 18 and two end walls 20 and fits in snug telescoping relationship within the outer sleeve, so that the slide is slidable within the sleeve against frictional resistance due to the snugness of the fit. The lower end wall 14 of the sleeve is formed with vent slots 22 to allow air to enter or leave the chamber via the lower end wall when the slide is moved within the sleeve. The lower end wall of the sleeve is provided with feet that space the lower end wall from the floor on which the caddy rests. The upper end wall 20 of the inner slide is provided with a hand grip 26 to facilitate sliding of the inner slide relative to the outer sleeve.

The interior space of the inner slide is divided into upper and lower compartments by an interior wall 28. A panel or flap 30 is attached to the wall 28 and is pivotable relative to the wall about a fold line or other form of hinge between the wall and the flap. The flap is pivotable between a closed position (FIG. 2), in which the interior space of the upper compartment is concealed, and an open position (FIG. 3) in which the interior space of the upper compartment is exposed. Side flaps 32 limit the risk of the contents of the upper compartment falling out in the event that the caddy does not remain upright when the caddy is in the open position. Preferably, each side flap fits in a pocket defined by one side wall of the slide and an interior wall (not separately shown) of the upper compartment.

The bathroom caddy is made of cardboard, folded and secured using conventional techniques for assembling cardboard boxes. Accordingly, the bathroom caddy may be sold or otherwise made available to a consumer in flat form, as one or more precut cardboard blanks, to be assembled by the consumer.

In typical use of the bathroom caddy, a spare toilet roll is placed in the lower compartment of the inner slide and feminine hygiene products are placed in the upper compartment of the inner slide. The flap is pivoted to its closed position and remains in the closed position due to frictional engagement with the side walls of the slide. The slide is pushed to its closed position. The caddy is placed upright on the bathroom floor adjacent the toilet bowl. The spare toilet roll and the feminine hygiene products are thereby concealed from view and do not clutter the bathroom. When access to the toiletry items in the bathroom caddy is needed, a user can readily grasp the caddy by the outer sleeve and pull the slide from the sleeve by lifting on the hand grip. The user can remove the spare roll of toilet paper from the lower compartment or open the flap over the first compartment to remove a feminine hygiene product. The user can then close the caddy and replace it on the bathroom floor. If the user replaces the caddy on the bathroom floor before closing the caddy, and then pushes down on the slide, air can escape from the sleeve through the vent slots 22 and between the feet 24.

Figure 1:
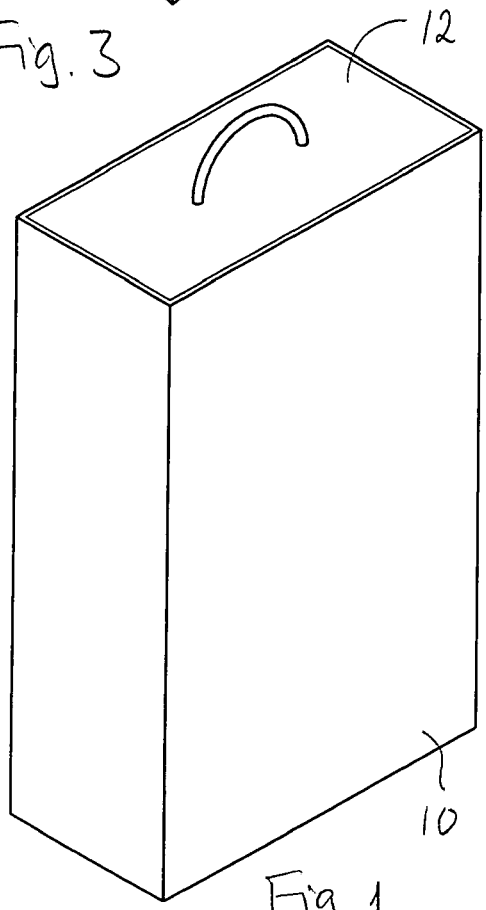
FIG. 1 is a perspective view of a bathroom caddy embodying the present invention in a closed position.
Figure 2:
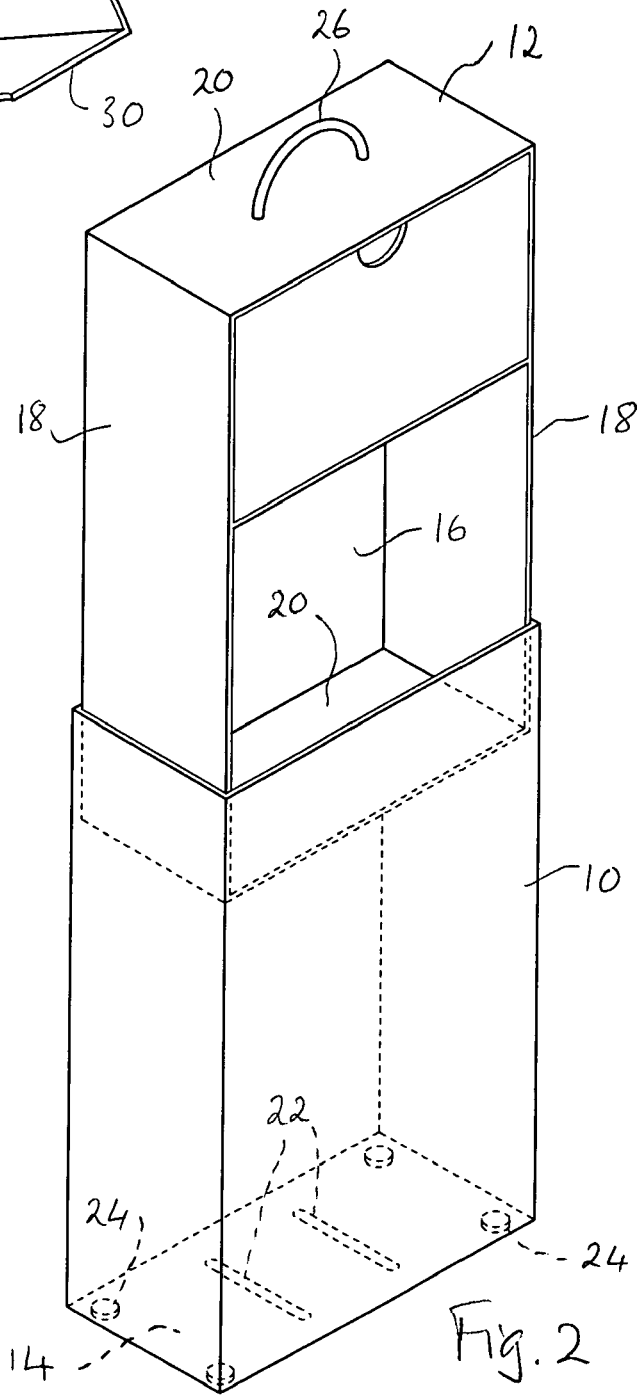
FIG. 2 is a similar view of the bathroom caddy in a partially open position.

In a first modification of the bathroom caddy described with reference to FIGS. 1-3, the outer sleeve and the inner slide are each substantially smaller in vertical extent. The upper compartment remains substantially the same size whereas the lower compartment is substantially smaller than shown and may not be large enough to store a spare toilet roll. Nevertheless, the bathroom caddy may be used to store feminine hygiene products and other items.

In a further modification of the bathroom caddy, there is no interior wall dividing the interior space of the inner slide into two compartments. The flap 30 is attached to the lower end wall of the inner slide and is pivotable between a closed position, in which the interior space of the inner slide is concealed, and an open position in which the interior space of the inner slide is exposed.

Both modifications of bathroom caddy are shorter in vertical extent than the caddy described with reference to FIGS. 1-3 and are suitable for resting on the toilet tank rather than on the floor.

It will be appreciated that the invention is not restricted to the particular embodiments that have been described, and that variations may be made therein without departing from the scope of the invention as defined in the appended claims and equivalents thereof. For example, although the invention has been described with reference to FIGS. 1-3 in connection with an implementation in which the interior space of the inner slide is divided into two compartments, one or more additional interior walls may be provided to divide the interior space into three or more compartments. Unless the context indicates otherwise, a reference in a claim to the number of instances of an element, be it a reference to one instance or more than one instance, requires at least the stated number of instances of the element but is not intended to exclude from the scope of the claim a structure or method having more instances of that element than stated. Further, a reference in the foregoing description to an element, be it a reference to one instance of that element or more than one instance, is not intended to imply that any claim should be interpreted as if it required that element or that embodiments of the invention could not be implemented without that element.

The invention claimed is:

1. A container for storing toiletry items, the container comprising:

an outer sleeve comprising first and second opposing side walls and opposing front and rear walls, the side walls and the front and rear walls defining an interior space and an opening providing access to the interior space, and an inner slide comprising a base, first and second opposing side walls and first and second opposing end walls, the base, the side walls and the end walls defining an interior space, and the inner slide also comprising an interior wall that divides the interior space of the inner slide into first and second compartments, and a panel that is hingedly attached to the interior wall and is movable between an open position, in which the interior space of the first compartment is exposed, and a closed position, in which the interior space of the first compartment is concealed, and wherein the inner slide is a snug sliding fit within the outer sleeve, whereby friction between the slide and the outer sleeve resists movement of the slide relative to the sleeve, and first and second side flaps extend from the hinged panel adjacent the first and second side walls respectively of the inner slide for preventing articles from falling from the interior space of the first compartment when the panel is in the open position.

2. A container according to claim 1, wherein the inner slide further comprises a hand grip attached to the first end wall of the inner slide to facilitate sliding of the inner slide relative to the outer sleeve.

3. A container according to claim 1, wherein the outer sleeve has first and second opposite ends, the opening is at the first end of the sleeve, the sleeve further comprises an end wall at the second end of the sleeve, and the end wall is formed with at least one vent aperture.

4. A container according to claim 3, wherein the container further comprises feet attached to the end wall, whereby in the event that the container is placed in a vertical orientation on a horizontal floor with the side walls and the front and rear walls vertical and the end wall downward, the feet space the end wall from the horizontal surface to allow air to enter or leave the interior space of the sleeve via the vent aperture.

5. A container for storing toiletry items, the container comprising:

an outer sleeve comprising first and second opposing side walls and opposing front and rear walls, the side walls and the front and rear walls defining an interior space and an opening providing access to the interior space, and an inner slide comprising a base, first and second opposing side wall and first and second opposing transverse walls, the base, the side walls and the transverse walls defining an interior space, and the inner slide also comprising a panel that is hingedly attached to a transverse wall of the inner slide and is movable between an open position, in which at least a portion of the interior space of the inner slide is exposed, and a closed position, in which said portion of the interior space of the inner slide is concealed, and wherein the inner slide is a snug sliding fit within the outer sleeve, whereby friction between the slide and the outer sleeve resists movement of the slide relative to the sleeve, and first and second side flaps extend from the hinged panel adjacent the first and second side walls respectively of the inner slide for preventing articles from falling from the interior space of the inner slide when the panel is in the open position.

6. A container according to claim 5, wherein the outer sleeve has first and second opposite ends, the opening is at the first end of the sleeve, the sleeve further comprises an end wall at the second end of the sleeve, the end wall is formed with at least one vent aperture, and the container further comprises feet attached to the end wall, whereby in the event that the container is placed in a vertical orientation on a horizontal floor with the side walls and the front and rear walls vertical and the end wall downward, the feet space the end wall from the horizontal surface to allow air to enter or leave the interior space of the sleeve via the vent aperture.

* * * * *